United States Patent [19]

Eijsermans

[11] 4,273,140

[45] Jun. 16, 1981

[54] DEVICE FOR SPREADING INDIVIDUAL TOBACCO LEAF HALVES

[75] Inventor: Petrus A. H. Eijsermans, Eindhoven, Netherlands

[73] Assignee: B.V. Arenco P.M.B., Best, Netherlands

[21] Appl. No.: 5,717

[22] Filed: Jan. 23, 1979

[30] Foreign Application Priority Data

Feb. 17, 1978 [NL] Netherlands ..... 7801797

[51] Int. Cl.[3] ..... A24B 5/14

[52] U.S. Cl. ..... 131/328; 131/314

[58] Field of Search ..... 131/147, 147 A, 123, 131/124, 125, 148

[56] References Cited

U.S. PATENT DOCUMENTS

| | | | |
|---|---|---|---|
| 2,212,520 | 8/1940 | Gwinn et al. | 131/123 |
| 3,612,067 | 10/1971 | Wallenborn | 131/147 R |
| 3,699,977 | 10/1972 | Hollenton | 131/123 X |
| 3,759,269 | 9/1973 | Wallenborn | 131/123 |

*Primary Examiner*—Stephen C. Pellegrino
*Attorney, Agent, or Firm*—John P. Snyder

[57] ABSTRACT

A device for spreading individual tobacco leaf halves, comprising a first conveyor formed by two endless elements, the operative runs of which are in contact with one another for clamping an edge part of the tobacco leaf portion and by a second conveyor, the conveying run of which joins the side of the first conveyor and the advancing direction of which is at an acute angle to that of the first conveyor, means being provided for lifting the operative runs of the first conveyor each time apart from one another, owing to the oblique conveyance of the second conveyor, the loose part of the tobacco leaf, laying on said second conveyor, which is moved away from the first conveyor while the transverse speed component of the second conveyor ensures stretching or spreading of the tobacco leaf.

12 Claims, 6 Drawing Figures

DEVICE FOR SPREADING INDIVIDUAL TOBACCO LEAF HALVES

Figure 1:
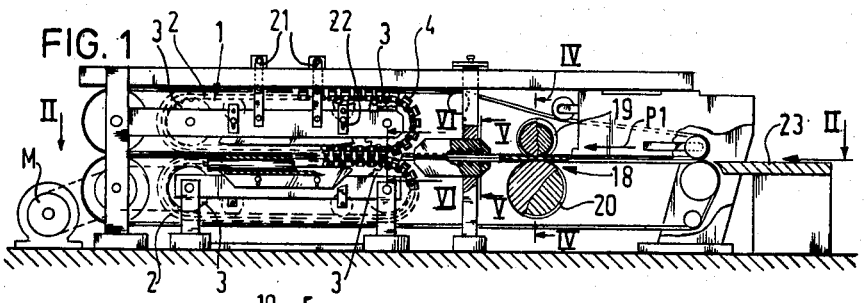

The invention relates to a device for spreading individual tobacco leaf halves.

In the cigar industry it is common practice to spread tobacco leaves suitable for wrappers or binders of cigars, after which the leaf is further treated, for example, cutting into portions which may subsequently be stored or worked up. Various systems for spreading are known, in which brushes are employed, the hairs of which smooth out the leaf or in which air streams are used for blowing the leaf into a smooth shape.

The invention has for its object to construct a device of the kind set forth in a manner such that the tobacco leaf is effectively stretched by comparatively simple, mechanical means, whilst the leaf is exposed to a minimum of frictional forces.

The device according to the invention is distinguished by a first conveyor formed by two endless elements, the operative runs of which are in contact with one another for clamping an edge part of the tobacco leaf portion and by a second conveyor, the conveying run of which joins the side of the first conveyor and the advancing direction of which is at an acute angle to that of the first conveyor, means being provided for lifting the operative runs of the first conveyor each time apart from one another.

In the device according to the invention first an edge part of the leaf is gripped and advanced in one direction. On the second conveyor is laying the loose part of the tobacco leaf, which is moved away from the first conveyor owing to the oblique conveyance of the second conveyor. The transverse speed component of the second conveyor ensures stretching or spreading of the tobacco leaf. Owing to the advancing movement of the tobacco leaf to be treated a continuous stream of tobacco leaves can be worked in order of succession without an appreciable change in direction of movement of the tobacco leaf.

In a preferred embodiment of the invention the device is suitable for working whole tobacco leaves. This device is distinguished by a first conveyor of double construction, the pairs of endless elements of which are arranged parallel to one another and by two second conveyors arranged symmetrically to the first conveyor, there being provided, viewed in the transport direction in front of the second conveyor, cutting means for cutting out the main rib of the tobacco leaf.

In order to ensure an undisturbed transport of the two leaf halves and of the cut-out main rib the invention proposes to provide a third conveyor formed by four ropes being pairwise in contact with one another and being passed in between the operative run of the double first conveyor, whilst the cutting means are arranged between the pairs of double ropes.

In this embodiment it is preferred to construct the endless elements of the first conveyor in the form of a plurality of relatively co-operating clamping members moved each along an uninterrupted path with a speed exceeding that of the third conveyor. In this way stretching of the leaf is ensured in the direction of length of the main rib.

A particularly simple second conveyor is obtained by constructing it in the form of a single endless conveyor belt, which is passed along at least one or two rollers respectively extending each in the direction of advancement of the first conveyor.

Figure 2:
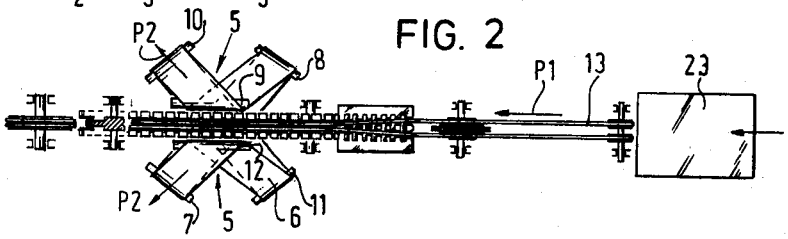
Figure 3:
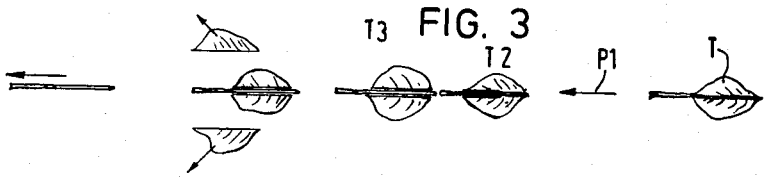
Figure 4:
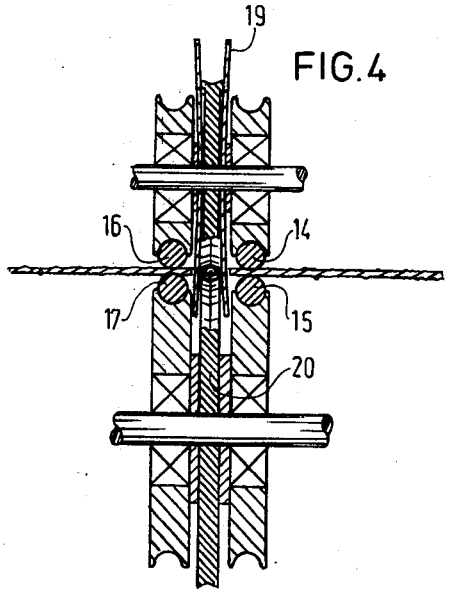
Figure 5:
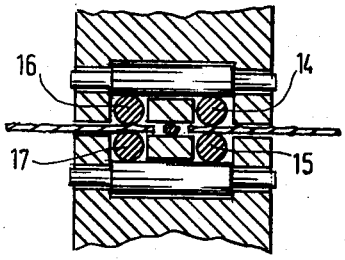
Figure 6:
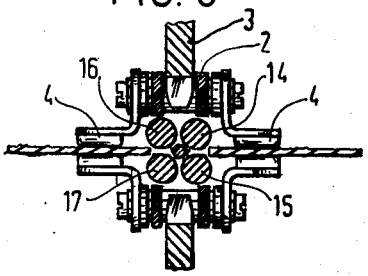

The invention will be described more fully with reference to an embodiment thereof. In the drawing FIG. 1 is a schematic side elevation of a device for spreading tobacco leaves, FIG. 2 is a plan view taken on the line II—II in FIG. 1, FIG. 3 schematically illustrates the treatment of tobacco leaves, FIGS. 4, 5 and 6 are sectional views of details taken on the lines IV—IV, V—V and VI—VI respectively in FIG. 1.

The device illustrated in the Figures comprises a first conveyor 1 formed by two endless clamping elements 2 arranged one above the other and formed by chains passed around two chain sprockets 3. Each link is provided with a clamping member 4 so that the clamping members 4 of the upper chain are located opposite those of the lower chain (see FIG. 6) so that a tobacco leaf T can be clamped tight, which will be explained more fully hereinafter. From FIG. 6 it will be apparent that on the other side of the chain 2 clamping members 4 are also provided for clamping the other half of the tobacco leaf.

The upper and lower chains 2 are relatively positioned so that in the operative runs of the chains the clamping members 4 are pressed against one another, whilst the clamping members 4 are advanced with a given speed in the direction of the arrow P1.

At the side of the chain conveyor 1 a second conveyor 5 is arranged in the form of an endless belt 6, the operative transport run of which is moved in the direction of the arrow P2. From FIG. 2 it will be seen that the belt 6 is passed along reversing rollers in a manner such that a single belt forms an operative transport surface on the left-hand side as well as on the right-hand side of the first conveyor 1. The belt 6 passes in order of succession along the rollers 7, 8, 9, 10, 11 and 12. The rollers 9 and 12 extend in the direction of conveyance P1 of the first conveyor.

There is furthermore provided a third conveyor 13 mainly comprising four ropes, which co-operate pairwise so that the operative parts of the ropes are in contact with one another (see FIGS. 4, 5 and 6). From these Figures it will be apparent that the ropes 14, 15 and 16, 17 respectively clamp between them a tobacco leaf portion T and thus convey the same in the direction of the arrow P1 in accordance with the conveying direction of the first conveyor 1. The ropes 14 and 16 of the upper part and 15 and 17 of the lower part are guided along suitable rope discs (not shown in detail) in the machine.

The first, second and third conveyors are preferably driven by the motor M shown on the left-hand side of FIG. 1. Suitable transmissions ensure the correct speeds, it being noted that the speed of the first conveyor slightly exceeds that of the third conveyor so that a difference in speed is obtained between the clamping members 4 and the ropes 14, 15 and 16, 17 respectively.

Between the pairs of ropes of the third conveyor 14, 15 and 16, 17 respectively are arranged cutting means 18 of known structure, formed by two circular knives 19 co-operating with a subjacent counterwheel 20 (see FIG. 4). These cutting means serve to cut out the main rib of the tobacco leaf. With respect to the conveying direction P1 the cutting means are located in front of the first and second conveyors.

All elements described above are arranged in a suitable frame (see FIG. 1) and only the upper chain of the first conveyor is journalled in a vertically movable frame in order to lift the upper chain from the lower chain 2. This is performed by moving the angular levers 21 out of the vertical position shown by which, along a vertical straight guide 22 the entire system of chains and chain sprockets can be moved upwards.

Finally, in order to facilitate the insertion of each tobacco leaf a receiving table: 23 is arranged on the right-hand side as shown in FIG. 1 so that the operator can insert each tobacco leaf into the machine.

The device according to the invention operates in the manner described with reference, inter alia to FIG. 3.

After the operator at the table 23 has inserted the main rib between the ropes 14, 15, 16 and 17, the tobacco leaf T1 is advanced in the direction of the arrow P1 to the left in the device. At the cutting station 19, 20 the main rib is cut out of the tobacco leaf T in known manner, which is shown in the position T2 of FIG. 3. Subsequently the halves of the tobacco leaf are conveyed on by the third conveyor whilst they are still clamped between the pairs of ropes 14, 15 and 16, 17 respectively (see FIG. 5). Beyond the position T3 of FIG. 3 the ropes get in between the clamping members 4 of the upper and lower chains 2, whilst the tobacco leaf T is taken over by the clamping members 4. Since each time only part of the tobacco leaf is gripped by the clamping members and since these members 4 run with a slightly higher speed than the ropes of the third conveyor, the edge part of the tobacco leaf T is stretched in the direction of the arrow P1.

The part of the tobacco leaf located beyond the clamping members and the ropes is supported on a horizontal table (not further described) up to the operative conveying surface of the second conveyor 5. As soon as the free part of the tobacco leaf touches the belt 6, it is caught along in the direction of the arrow P2. The transport direction P2 resolved into a component parallel to the conveying direction P1 and into a component at right angles thereto. The latter component stretches the leaf laterally, whereas the parallel component equals the conveying speed of the first conveyor. Thus a non-deformed stretched tobacco leaf portion is obtained. As soon as a pulse actuates the mechanism 21, the upper chain 2 moves upwards and the tobacco leaf lies freely on the belt 6.

By providing a suction surface beneath the operative surface of the belt 6 the stretched state of the tobacco leaf is maintained. Then the tobacco leaf portion is picked up from the belt 6 for further treatment.

As a matter of course, other embodiments are possible within the scope of the invention. For example, the Figures show a device for working a complete tobacco leaf, but it will be obvious that half the device according to the invention may be used in which each tobacco leaf half is inserted between a pair of ropes 14, 15, whilst only a left-hand or a right-hand part of the conveyor belt 6 is present. For this purpose a single belt may be employed.

What is claimed is:

1. A device for stretching a tobacco leaf half comprising in combination:

first conveyor means for moving a tobacco leaf half along a first path at a predetermined speed;

second conveyor means for progressively intercepting, stretching and capturing said tobacco leaf half as it is moved by said first conveyor means and moving said tobacco leaf half along a second path divergent from said first path at a speed such that the direction of said second path has a component parallel and equal in speed to said first path and another component perpendicular to said first path whereby said tobacco leaf half is stretched in a direction perpendicular to said first path and captured in stretched state by said second conveyor means as it is moved along said second path.

2. A device for stretching a tobacco leaf comprising in combination:

first conveyor means for receiving and moving two halves of a split tobacco leaf side-by-side along a first path at a predetermined speed;

second conveyor means for progressively intercepting said tobacco leaf halves as they are moved by said first conveyor means and respectively moving each of said tobacco leaf halves along separate paths oppositely divergent from said first path each at a speed such that the direction of each of said paths has a component parallel and equal in speed to said first path and another component perpendicular to said first path whereby each of said tobacco leaf halves is stretched in a direction perpendicular to said first path and maintained in stretched state by said second conveyor means as it is moved along its respective divergent path.

3. A device as claimed in claim 2 wherein said second conveyor means comprises a single endless belt with a path guided in part by two rollers, one on either side of said first path, having their axes parallel to said first path whereby both of said divergent paths are provided by said single endless belt.

4. A device as claimed in claim 3 wherein said single endless belt is of the suction type.

5. A device for stretching a tobacco leaf comprising in combination:

cutting means for cutting out the main rib of a tobacco leaf;

first conveyor means for moving a tobacco leaf along a first path intersecting said cutting means and maintaining the severed leaf halves in side-by-side relation along said first path at a predetermined speed;

second conveyor means for successively intercepting said leaf halves as they are moved by said first conveyor means and moving said leaf halves side-by-side along a second path similar in direction to said first path at a speed greater than said predetermined speed whereby each of said leaf halves is stretched in the direction of said paths and maintained in stretched state by said second conveyor means as it is moved along said second path;

third conveyor means for progressively intercepting said leaf halves as they are moved by said second conveyor means and respectively moving each of said leaf halves along separate paths oppositely divergent from said second path each at a speed such that the direction of each of said paths has a component parallel and equal in speed to said second path and another component perpendicular to said first path whereby each of said leaf halves is stretched in a direction perpendicular to said second path and maintained in stretched state by said third conveyor means as it is moved along its respective divergent path.

6. A device as claimed in claim 5 wherein said first conveyor means comprises two pair of endless elements each pair travelling parallel to one another through a portion of their respective paths in side-by-side relation to the other pair along said first path whereby the tobacco leaf is gripped on either side of the main rib by one of said two pair of endless elements so as to be moved along said first path.

7. A device as claimed in claim 6 wherein said cutting means is disposed between said two pairs of endless elements.

8. A device as claimed in claim 7 including a further means for displacing said two pair of endless elements toward one another after intersecting said cutting means whereby the main rib is gripped by said two pair of endless elements and moved thereby along a path extending from said first path.

9. A device for stretching a tobacco leaf half comprising in combination:

first conveyor means for moving a tobacco leaf half along a first path at a predetermined speed;

second conveyor means for successively intercepting said tobacco leaf half as it is moved by said first conveyor means and moving said tobacco leaf half along a second path similar in direction to said first path at a speed greater than said predetermined speed whereby said tobacco leaf half is stretched in the direction of said paths and maintained in stretched state by said second conveyor means as it is moved along said second path, said second conveyor means comprising a sequence of opposing clamping members carried by two endless elements travelling parallel to one another through a portion of their respective paths.

10. A device for stretching a tobacco leaf, comprising in combination:

first conveyor means for holding a leaf lengthwise and transporting it along a predetermined path, at a predetermined speed; and second conveyor means for stretching and capturing the leaf as it is moved along said path whereby the leaf is transferred to said second conveyor means in stretched state.

11. A device as defined in claim 10 wherein said second conveyor means includes drive means for travelling the second conveyor means in the same direction as said path but at a speed greater than said predetermined speed.

12. A device as defined in claim 10 wherein said second conveyor means includes drive means for travelling the second conveyor means in a direction divergent from said path and at a speed such that the second conveyor means has a speed component parallel to said path which is the same as said predetermined speed.

* * * * *